US005328134A

United States Patent [19]

Powers

[11] Patent Number: 5,328,134

[45] Date of Patent: Jul. 12, 1994

[54] DUAL-LINE OR QUAD-LINE CONTROLLED KITE

[76] Inventor: Thomas C. Powers, 208 Ramblewood Dr., 1-D, Fairfield, Ohio 45014

[21] Appl. No.: 109,041

[22] Filed: Aug. 17, 1993

[51] Int. Cl.[5] ..... B64C 31/06

[52] U.S. Cl. ..... 244/155 A; 244/153 R

[58] Field of Search ..... 244/153 R, 155 A, 155 R

[56] References Cited

U.S. PATENT DOCUMENTS

| | | | |
|---|---|---|---|
| D. 274,827 | 7/1984 | Belloff | D21/88 |
| 2,388,478 | 11/1945 | Garber | 244/153 R |
| 3,347,500 | 10/1967 | Hartig | 244/153 R |
| 3,446,458 | 5/1969 | Ragallo | 244/153 R |
| 4,286,762 | 9/1981 | Prouty | 244/153 R |
| 4,363,458 | 12/1982 | Jones et al. | 244/153 R |
| 4,736,914 | 4/1988 | Tabor | 244/153 R |
| 4,807,832 | 2/1989 | Tabor | 244/153 R |
| 4,892,272 | 1/1990 | Hadzicki | 244/153 R |
| 4,958,787 | 9/1990 | Sterling | 244/153 R |
| 4,981,273 | 1/1991 | Petteys | 244/153 R |
| 5,054,718 | 10/1991 | Hull et al. | 244/155 A |
| 5,120,006 | 6/1992 | Hadzicki | 244/153 R |

*Primary Examiner*—Michael S. Huppert
*Assistant Examiner*—Anne E. Bidwell
*Attorney, Agent, or Firm*—Oblon, Spivak, McClelland, Maier & Neustadt

[57] ABSTRACT

A kite of delta shape having a frame and sail defining a keel and a pari of wings. Primary and secondary bridle lines are connected together and to the frame and carry connectors, two being located for dual line control and four being located for quad line control whereby the flyer can select either type of control depending on the desired variation he may wish in the maneuvers of the kite while flying.

12 Claims, 9 Drawing Sheets

DUAL-LINE OR QUAD-LINE CONTROLLED KITE

FIELD OF THE INVENTION

This invention relates to kites and more particularly to a kite which may alternatively be controlled by two or by four control lines.

BACKGROUND OF THE INVENTION

Keeled kites are well known and dual control line kites wherein kite lines are attached to the kite on opposite sides of its center line are known as, for example, in the U.S. Pat. No. 4,807,832 to Tabor. Four or quad line kite control is also known as in the U.S. Pat. No. 5,120,006 to Hadzicki. Heretofore there has not been a kite which has been constructed to enable its control alternatively by either two lines, i.e. "dual line" control or four line, i.e. "quad line" control.

The broad object of the invention is to provide such a kite.

It is another object of the invention to provide improved construction of a keeled delta wing kite for dual or quad line control.

DETAILED DESCRIPTION OF THE INVENTION

Figure 1:
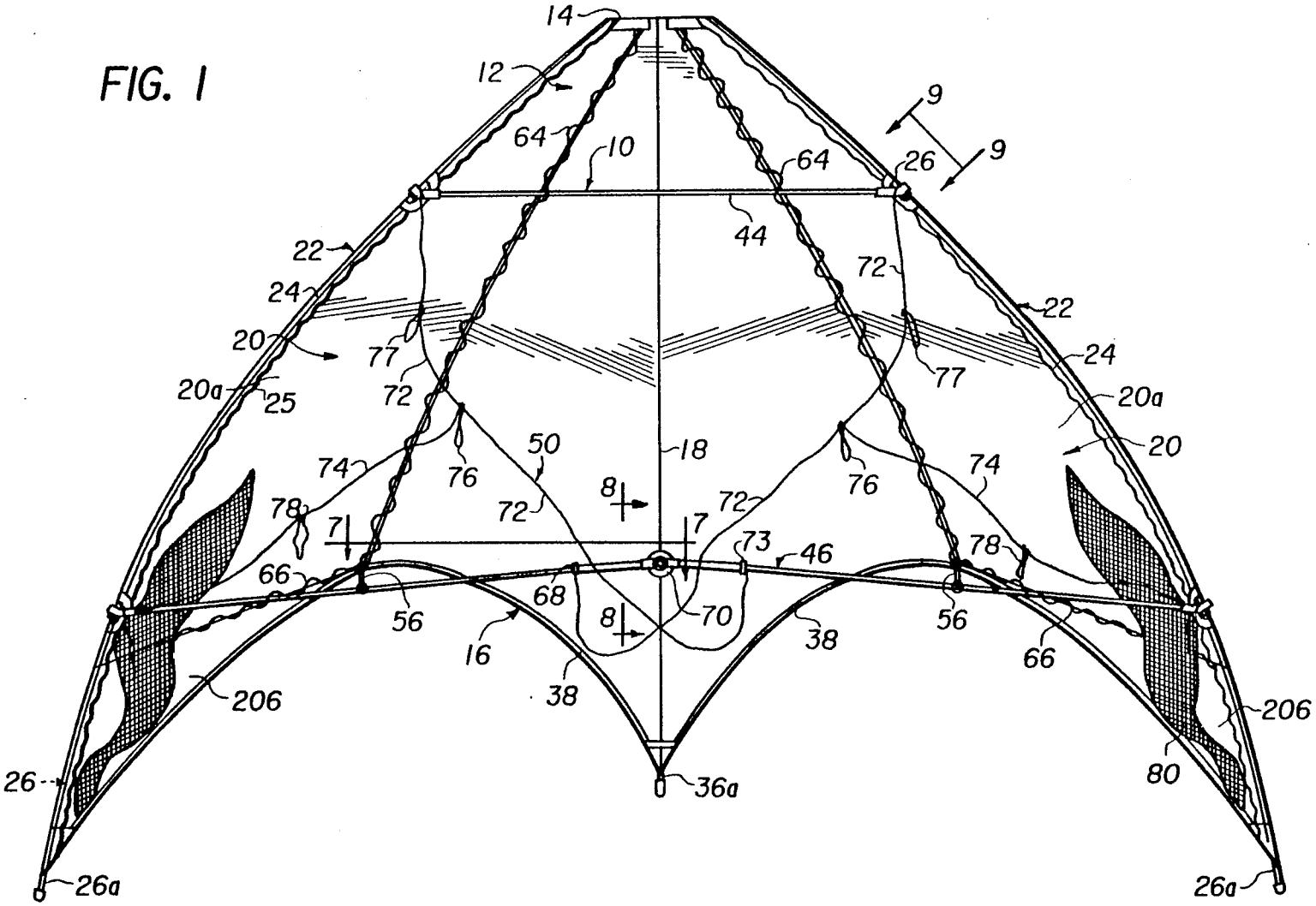
FIG. 1 is a front elevational view of the kite of the invention.

The kite of the present invention comprises the combination of a frame 10 composed of hollow flexible struts, described in detail hereafter, and a sail 12 of fabric sheet material such as woven nylon cloth. The frame and sail define a kite of substantially delta shape having a narrow front end 14 and a wide trailing end 16, a central keel 18 a pair of wings 20 one each on an opposed side of the keel 18. The wings 20 have leading edges 22 defined respectively by first and second seams 24, each of which is closed at the upper narrow end 14 of the delta shape of the assembly and open at the lower opposite end. The seams are closed to form the leading edges 22 of the wings 20 by a line of stitching 25 which may be of a sinuous configuration as shown in FIGS. 1 and 3.

Figure 3:
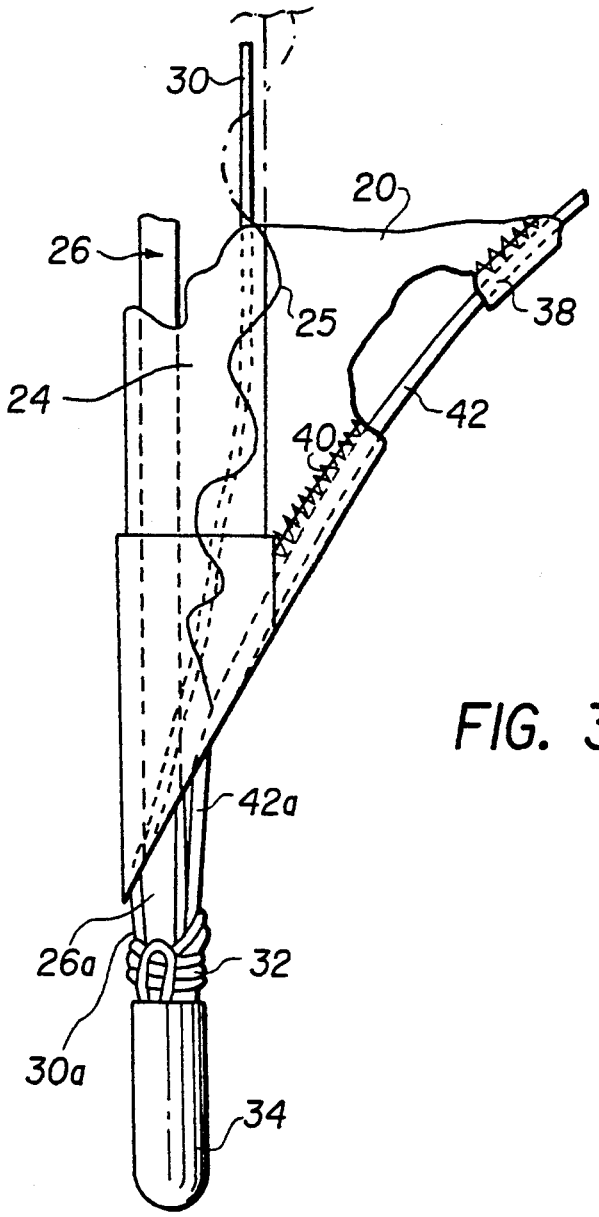
FIG. 3 is a broken enlarged detailed view of structure within the circle marked III in FIG. 2.

The frame 10 of the kite is defined, in part, by a resilient side strut 26 received in each of the respective seams 24, each of the struts 26 having an exposed end **26*a* extending freely through the open end of a respective seam 24 and beyond the wide end of the delta shape as best seen in FIG. 3. First and second flexible lines 30 are located in the respective seams 24, each line being sewn to the sheet material 20 by the line of stitching 25 whereby the line is anchored to the sheet material substantially parallel to the seam. The lines 30 need only extend partway up portions of the length of the seams 24 since their function is to tighten the sail material along the side struts 26 after the free end 30*a* of each line, where it emerges from the open end of its seam, has been grasped, tensioned and then anchored to the exposed end 26*a* of a side strut 26 as best seen in FIG. 3. The means for anchoring the ends 30*a* of the lines 30 to the strut ends can be simply "taut-line" knots, such as those shown at 32, and which may be partially covered by socket members 34**, which also serve as anchoring elements.

Figure 2:
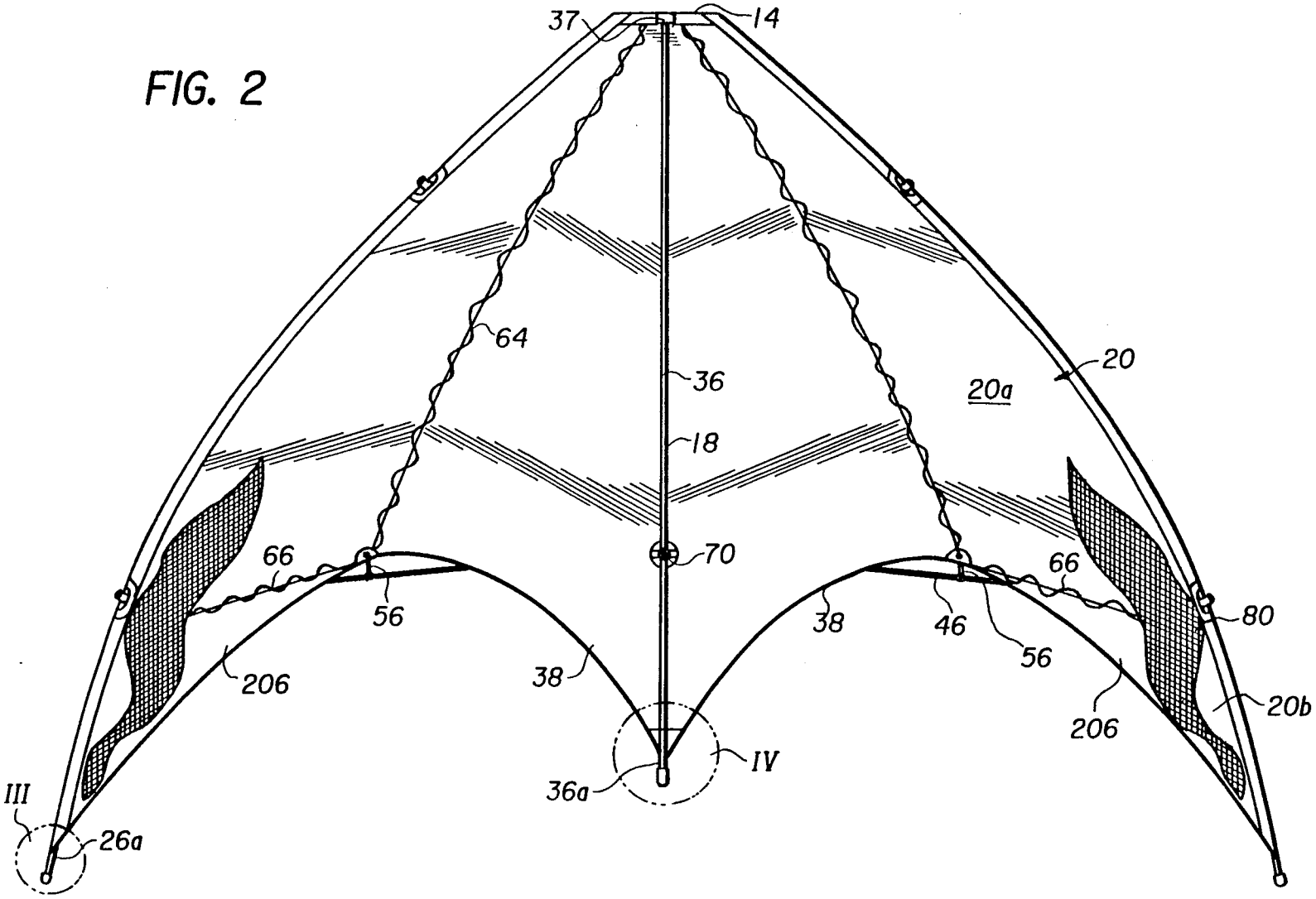
FIG. 2 is a rear elevational view of the kite of the invention.
Figure 4:
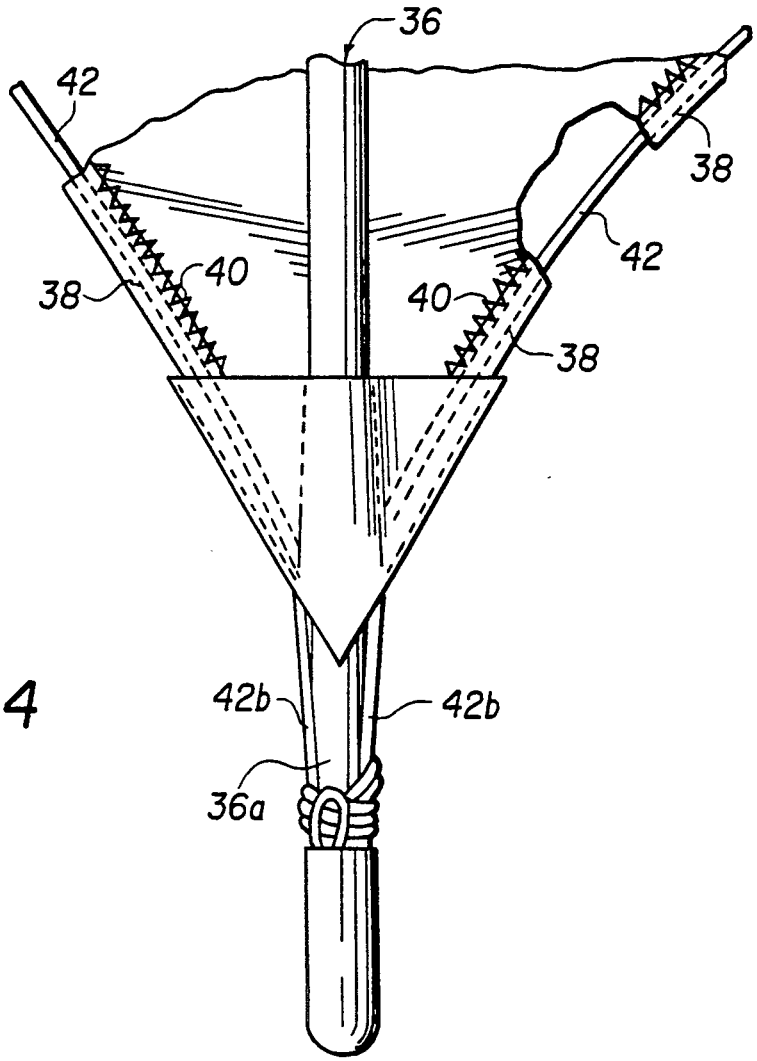
FIG. 4 is a broken enlarged detailed view of structure within the circle marked IV in FIG. 2.

In addition to the side struts 26, the kite frame includes a center strut 36, as best seen in FIGS. 2 and 4, disposed equi-distant between the side struts 26. A rearwardly open pocket 37 is disposed at the center of the narrow front end 14 of the delta shape, one end of the center strut 36 being received in the pocket, the opposite end **36*a* of the center strut extending freely beyond the center of the wide end 16 of the delta shape. Third and fourth rear end seams 38 are formed by lines of stitching 40 along the wide end 16 of the delta shape, each of the end seams 38 extending between an exposed end 26*a* of a respective side strut 26 and the exposed end 36*a* of the center strut 36, the end seams 38 defining hollow tunnels open at both ends. Third and fourth flexible lines 42 pass freely through the respective third and fourth seams 38 and have exposed ends 42*a* and 42*b*, see FIGS. 3 and 4, extending beyond the open opposite ends of the seams 38, means, such as the taut line knots similar to knot 32, anchor the exposed ends of each of the respective third and fourth lines 42 to the exposed ends 36*a* of the center strut 36 and to the exposed end 26*a* of a side strut 26**, respectively.

It will be observed in FIGS. 1 and 2 that each of the third and fourth seams is curved in the direction of the narrow front end of the delta shape.

In addition to the side and center strut 26, 36, the frame 10 further comprises a first lateral strut 44, FIG. 1, having a predetermined length corresponding to the width of the delta shape at a first selected distance from the narrow end 14 of the delta shape. A second lateral strut 46 has a predetermined length greater than that of the first lateral strut and corresponding to the width of the delta shape at a second selected distance, greater than the first, from the narrow end 14 of the delta shape. Means are provided for connecting the opposed ends of the struts 44, 46 to exposed portions of the respective side struts 26 with the struts being substantially parallel to each other, normal to the center strut 36, and on the side of the sail fabric opposite the center strut 36.

Figure 9:
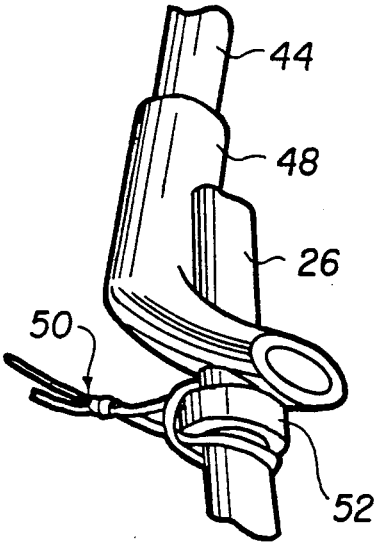
FIG. 9 is a broken perspective view of a typical connector for two struts as used in the frame of the kite of the invention.

A preferred connecting means is illustrated in FIG. 9 where a short piece of hollow flexible tubing 48, is apertured at one end to receive therethrough an exposed portion of a side strut 26. The opposite end of the tubing 48 defines a socket to receive an end of a lateral strut, say strut 44. As will be explained more fully hereinafter, an end of a kite line harness, broadly designated by the numeral 50 is connected to the respective side struts 26 at each juncture of a side strut with a lateral strut. As can be seen in FIG. 9, stop collars 52 are adhered to the side struts 26 below the tubular connectors 48 to retain the connectors in their positions of use on the side struts and also to serve as anchors for the ends of the kite line harness 50 as should be clear from FIG. 9.

Figure 7:
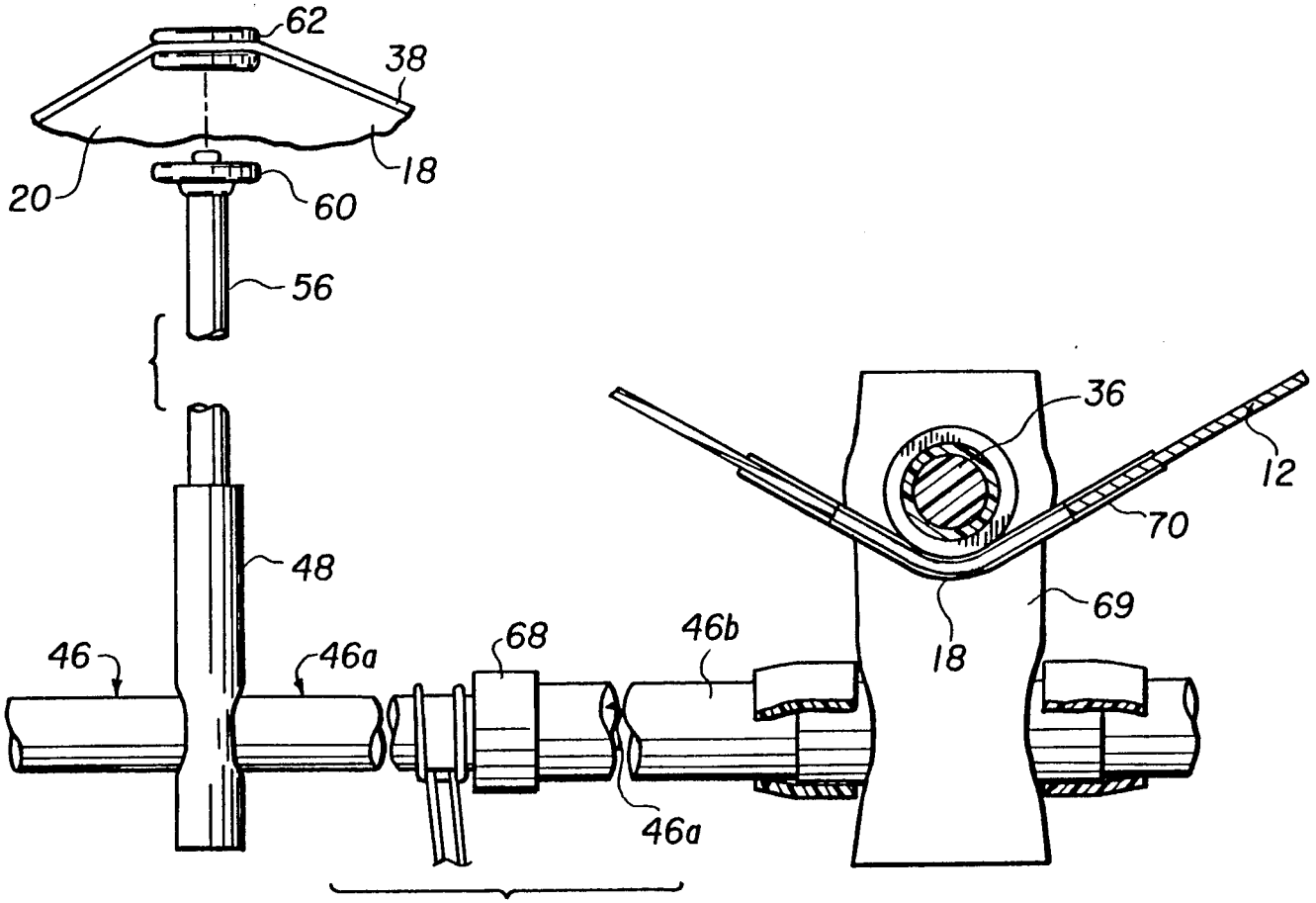
FIG. 7 is an enlarged horizontal, broken cross sectional view taken substantially on the line 7—7 of FIG. 1.
Figure 5:
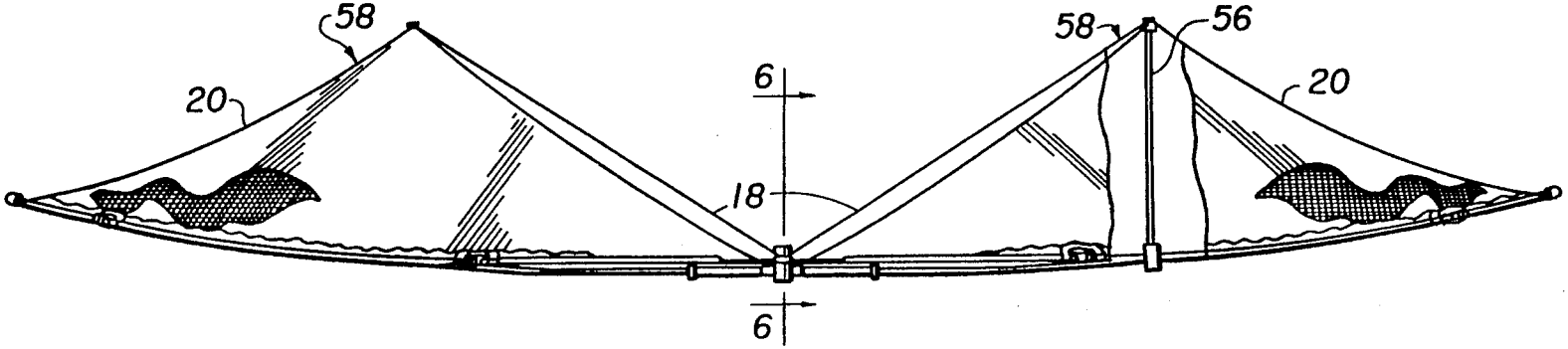
FIG. 5 is a front elevational view, partly broken away, of the kite of the invention.
Figure 6:
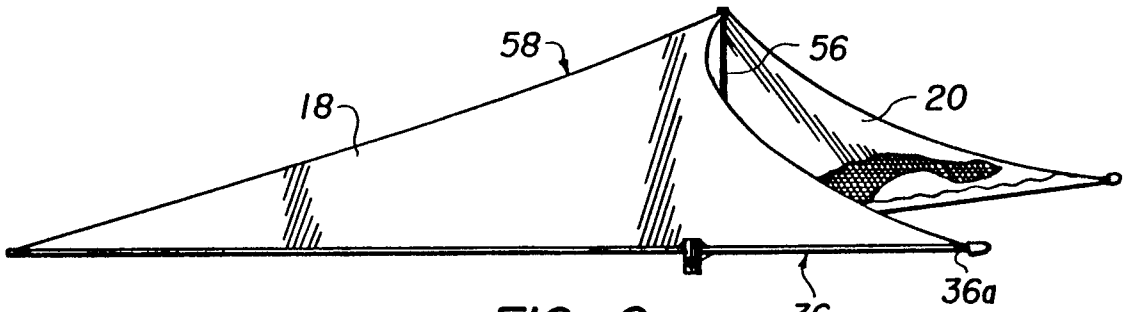
FIG. 6 is a vertical cross sectional view looking substantially in the direction of the arrows 6—6 in FIG. 5.

The frame is completed by a pair of laterally spaced transition struts 56 each having one end connected, as by a tubular socket member 48 as that described in FIG. 9 and see particularly FIG. 7, to the second lateral strut 46 intermediate a respective side strut 26 and the center strut 36. The opposite end of each transition strut 56 is releasably connected to the respective third and fourth seams 38 at a predetermined positioned along the lengths thereof and normal to the lateral strut 46. Each transition strut 56 and each of the third and fourth lines 42 have a length which, when the strut is in its position of use, the third and fourth lines are tensioned to tension the sail and define a pair of laterally spaced ridges, 58, FIG. 5, whose adjacent inner walls define the keel 18 and whose outer walls define the wings 20.

The preferred means for connecting the opposite ends of the transition struts 56 to the third and fourth end seams 38 comprise male and female garment snap fasteners 60, 62 (FIG. 7) one being carried by the end of a transition strut 56 and the other being fixed to an end seam 38.

The keel 18 of the kite is desirably cut from a single piece of fabric and joined by lap seams and lines of stitching 64 to upper parts 20*a* of the wings 20. The lower parts or wing tips 20*b* of the wings are joined by seams and stitching 66 to the upper parts 20*a*, these five components of the sail being cut in such a manner that when assembled the material bias will align for proper elasticity regarding their placements. Stated differently the sail components are designed to be assembled in such a manner as to define and strengthen the keel to wing and wing to wing tip sections thereby providing structural integrity for the entire kite.

Figure 8:
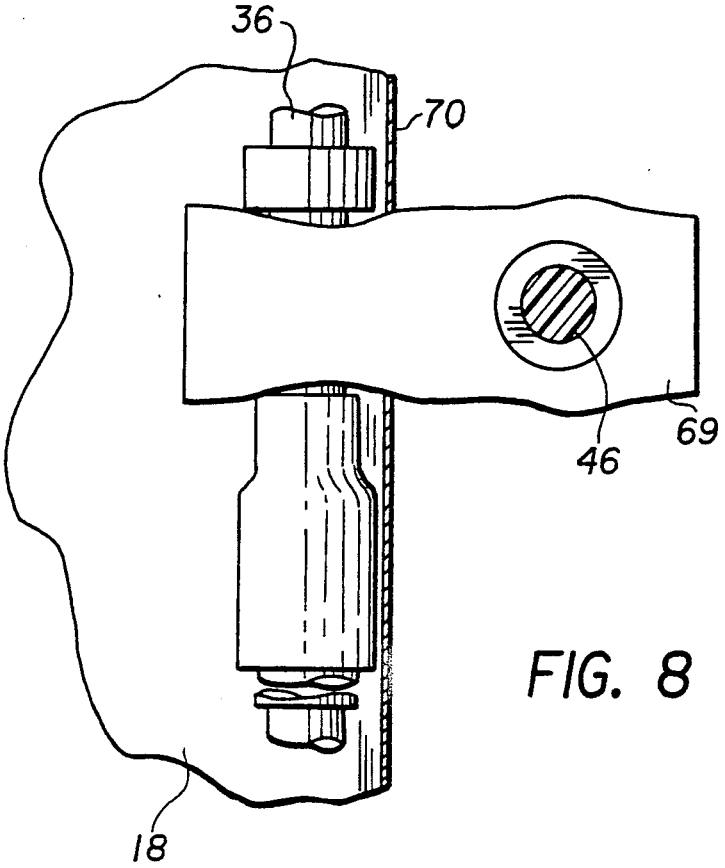
FIG. 8 is a vertical cross sectional view taken substantially on the line 8—8 of FIG. 1.

With reference again to FIG. 7 the second lateral strut 46 may, for convenience, be composed of a first part 46*a* which is telescopically received within a second part 46*b*. The two parts are biassed towards each other due to the tensioning force of the transition struts 56, a stop collar 68 being adhered to the section 46*a* for engagement with the end of section 46*b* to locate the parts in their proper relative positions. The lateral strut 46 is connected to the center strut 36 by means of a tubular connector 69 extending through an opening 70 (FIGS. 1, 7 and 8) in the sail fabric.

The kite line bridle 50, in accordance with the invention, comprises a pair of primary flexible lines 72 (FIG. 1) each connected at one end to a side strut 26 adjacent its juncture with an end of lateral strut 44 and is connected at its opposite end across the keel 18 to lateral strut 46 at a predetermined distance from the central strut 36. The strut 46 is provided with a collar 73, which with collar 68, provide anchors for the opposite ends of lines 72. The bridle 50 also includes a pair of secondary flexible lines 74 each connected at one end to a side strut 26 adjacent its juncture with lateral strut 46 and at its opposite end with a primary line intermediate the ends thereof but preferably closer by a predetermined distance to the intersection of primary line 72 with side strut 26.

For dual kite line control, attachment means such as the loops 76 shown, are provided at the intersection of each secondary line 74 with a primary line 72. For quad line control, first and second pairs of loops 77, 78 are provided, one loop 77 of a quad line control pair being located on each primary line 72 substantially midway between its intersection with a side strut and its intersection with a secondary line 74, the loop 78 of the other pair being located substantially at the midpoint of a secondary line 74.

Each wing 20 is provided with a vent 80 occupying the central portion of each wing tip 20*b* and extending into the wing proper as shown. The purpose of the vents is to increase the sensitivity of the kite in its response to manipulation of the dual or quad kite line controls.

Figure 10:
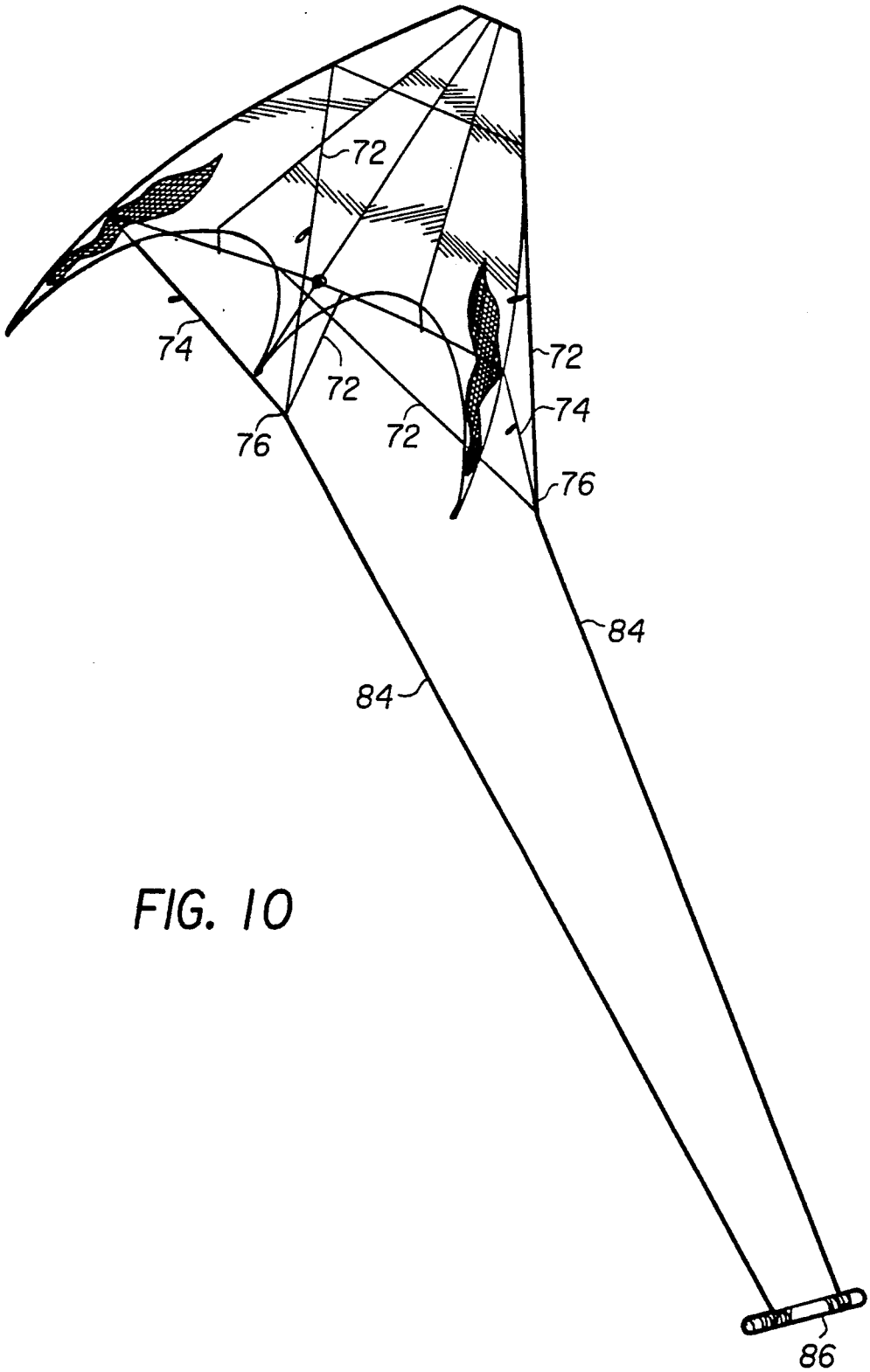
FIG. 10 is a schematic view showing the kite line bridle of the invention rigged for dual line control, the sail, for illustrative purposes only, being depicted as if it were transparent.

With reference now to FIG. 10 it will be observed that under dual line control each primary line 72 with a secondary line 74 forms a three point connection at loop 76 with one end of each of a pair of kite lines 84 of a dual line control whose opposite end is connected to one end of control stick 86. The kite is maneuvered by twisting the stick in a manner known to those skilled in the art of flying maneuverable kites.

Figure 11:
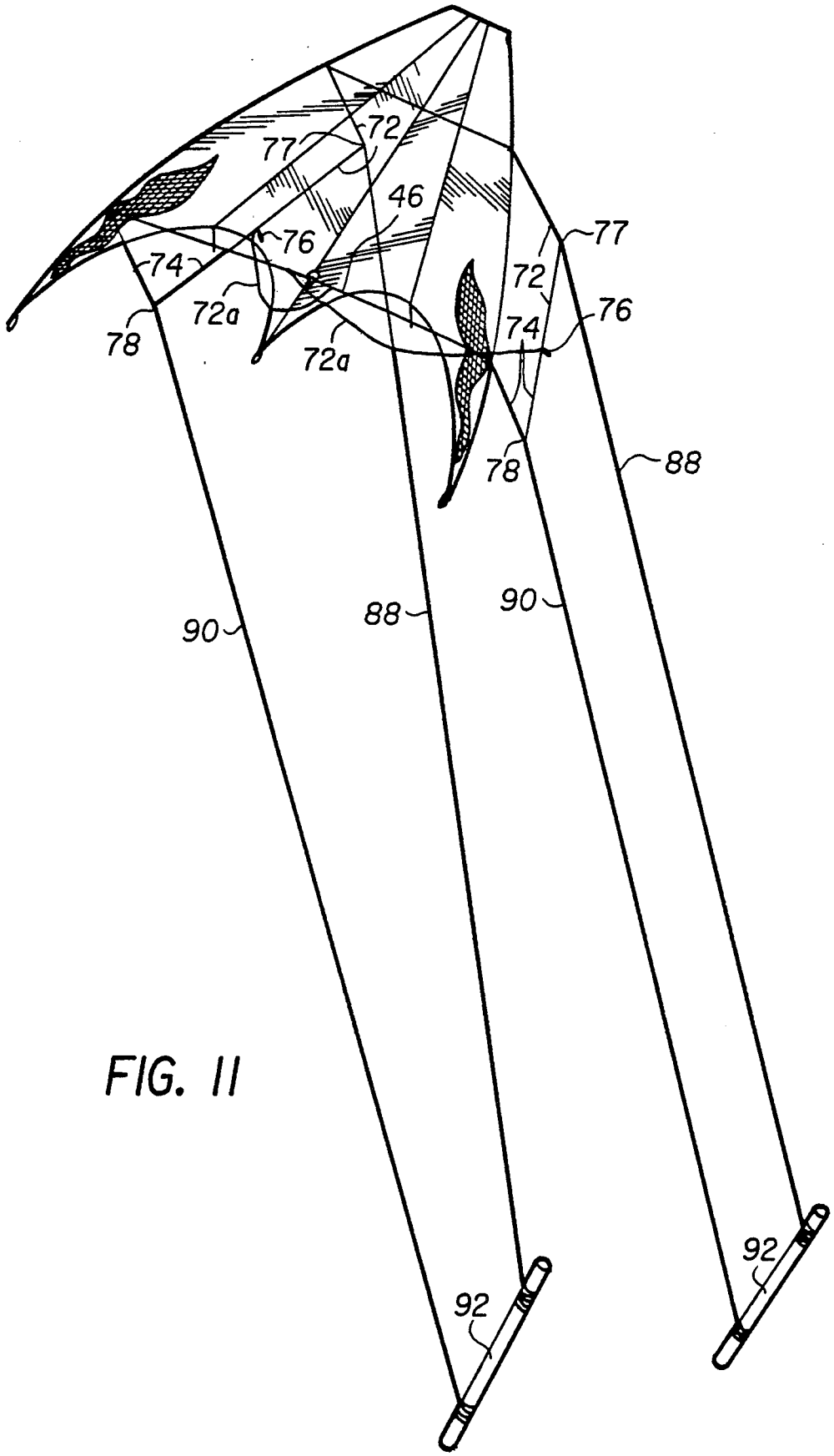
FIG. 11 is a view similar to FIG. 10 but showing the kite line bridle of the invention rigged for quad line control.

For quad line control as shown in FIG. 11 the ends of each pair of control lines 88, 90 are connected to the respective loops 77, 78. Thus in flight, the part of secondary line 74 between loop 78 and the connection of line 74 at loop 76, with primary line 72, between loops 76 and 77, form a straight line between the loops 77 and 78 as is apparent in FIG. 11. The other part of secondary line 74 between loop 78 and the intersection of line 74 with side strut 26 defines one leg of a rectangular bridle whose opposite leg is defined by that part of primary line 72 between loop 77 and its point of intersection with side strut 26. The remainder of primary line 72 between loop 76 and the intersection of line 72 with strut 46 is idle as depicted by the portion of line 72 marked 72*a* in FIG. 11.

For quad control, the opposite ends of each pair of control lines 88, 90 are connected respectively to a separate control stick 92. Those skilled in the art of quad line control of kites will recognize that a kite can be put through a wide range of maneuvers and stunts by manipulating the sticks 92.

Having now described the invention, what is claimed is:

1. A kite assembly comprising the combination of a frame and a sail of fabric sheet material, said frame and said sail defining a substantially delta shape having a narrow front end and a wide trailing end, a central keel and a pair of wings one each on the opposed sides of said keel, said wings having leading edges defined, respectively, by first and second seams each closed at the narrow end of said delta shape and open at its opposite end, stitching closing said seams to form said leading edges, said frame being defined, in part, by a resilient side strut received in each of the respective seams, each strut having an exposed end extending freely through the open end of a respective seam and beyond the wide end of said delta shape, first and second flexible lines within the respective seams, each line being sewn to said sheet material by a line of stitching extending along at least a portion of the length of said seam whereby said line is anchored to said sheet material along said portion substantially parallel to said seam, one end of each of said lines emerging from a seam at its open end, and means for anchoring said line securely to the exposed end of a side strut following tensioning of said line until said sheet material along a leasing edge is pulled taut along said strut.

2. The assembly of claim 1 wherein said frame includes a center strut disposed equi distant between said side struts, means for connecting one end of said center strut centrally to the narrow front end of said delta shape, the opposite end of said center strut extending freely beyond the center of the wide end of said delta shape, third and fourth end seams in said sheet material along the wide end of said delta shape, each of said third and fourth end seams extending between an exposed end of a respective side strut and the exposed end of said center strut said seams being open at both their ends, third and fourth flexible lines passing freely through the respective third and fourth seams and having exposed ends extending beyond the open ends of said seams, and means for anchoring the exposed ends of each line respectively to the exposed end of said center strut and to an exposed end of a respective side strut.

3. The assembly of claim 2 wherein each of said third and fourth seams is curved in the direction of the narrow front end of said delta shape.

4. The assembly of claim 3 wherein said frame further comprises a first lateral strut having a predetermined length corresponding to the width of said delta shape at a first selected distance from the narrow end of said delta shape, a second lateral strut having a predetermined length greater than that of said first lateral strut and corresponding to the width of said delta shape at a second selected distance, greater than the first, from the narrow end of said delta shape, means for connecting opposed ends of said first and second lateral struts to exposed portions of the respective side struts with both of said struts being substantially parallel to each other and on a side of said fabric material opposite said center strut, and a pair of laterally spaced transition struts, each having one end pivotally connected to said second lateral strut intermediate a respective side strut and said center strut, and means for releasably connecting the opposite ends of each transition strut to the respective third and fourth seams at a predetermined position along the length thereof, each transition strut and each of said third and fourth lines in said third and fourth end seams having lengths which, when a transition strut is in its position of use said third and fourth lines are tensioned to tension said sheet material and define a pair of laterally spaced ridges having adjacent inner walls defining said keel and spaced apart outer walls defining said wings.

5. The assembly of claim 4 wherein the releasable connecting means for the opposite ends of said transition struts comprise male and female snap fastener elements one of said elements being carried by the end of said transition strut and the other of said elements being carried on the respective third and fourth end seams.

6. The assembly of claim 4 including means for connecting the mid point of said second lateral strut to said center strut through an opening through said sheet material.

7. The assembly of claim 4 including a kite line bridle comprising a pair of primary flexible lines, each connected at one end adjacent a juncture of an end of said first lateral strut with a side strut and connected at the other end across said keel to said second lateral strut a predetermined distance from said center strut, a pair of secondary flexible lines each connected at one end adjacent a juncture of an end of said second lateral strut with a side strut and, at its opposite end with a primary line intermediate the ends thereof, means for attaching kite lines for dual line control of said kite at the intersection of each secondary line with a primary line, and two pairs of other means for attaching kite lines for quad line control, one of each pair of said other members being located substantially midway on each primary line between its intersection at one end with a side strut and its intersection at its other end with a secondary line, and the other attachment point of each pair being located substantially at the mid point of each secondary line.

8. The assembly of claim 7 wherein said attachment means comprise loops in said lines.

9. The assembly of claim 7 wherein the opposite end of each of said secondary lines is connected to a primary line at a position spaced a predetermined distance from the mid point of said primary line towards its connection at the juncture of said first lateral strut with a side strut.

10. The assembly of claim 4 wherein the exposed ends of said side struts extend rearwardly a distance greater than said center strut, the portions of said wings between said transition struts and the exposed ends of said side struts defining wing tips, and a vent in each wing tip and contiguous portion of a wing, said vents being adjacent said first and second seams respectively.

11. A kite comprising a body having front and rear ends and including a frame and a sail supported on said frame to define a central keel extending between the ends of said body and a pair of wings, said frame including a pair of side struts at the leading edges of said wings, a first lateral strut extending across said keel and having its opposite ends connected to said side struts at a first predetermined distance from said front end, a second lateral strut extending across said keel and having its opposite ends connected to said side struts at a second predetermined distance, greater than the first, from said front end, and a bridle for flying said kite alternatively by either dual or quad line control, said bridle comprising a pair of primary bridle lines each having one end connected to a side strut adjacent its connection with an end of said first lateral strut, the opposite end of each primary bridle line being connected to said second lateral strut across said keel and at a predetermined position on said second strut to one side of said keel, a pair of secondary bridle lines, each having one end connected to a side strut adjacent its connection with an end of said second lateral strut and its opposite end connect to a primary line intermediate the ends thereof, a first pair of dual kite control line connectors, each being located at the respective intersections of said secondary and primary bridle lines, and second and third pairs of quad kite control line connectors, one of each second pair of connectors being connected to said primary line intermediate its intersections with said side strut and said secondary bridle line, and one of each third pair of connectors being connected to said secondary line intermediate its connection with a side strut and its connection with said primary line.

12. The kite of claim 11 wherein said connectors comprise loops.

* * * * *